United States Patent [19]

Sheets

[11] 4,033,509

[45] July 5, 1977

[54] LAWN SPRINKLER AND FERTILIZER DISPENSER

[76] Inventor: Kerney T. Sheets, P.O. Box 637, Duplessis, La. 70728

[22] Filed: Mar. 6, 1975

[21] Appl. No.: 555,957

[52] U.S. Cl. ..... 239/226; 239/311; 239/318; 251/207

[51] Int. Cl.[2] ..... B05B 3/02

[58] Field of Search ..... 239/318, 232, 61, 310, 239/311, 226, 354; 251/206, 207

[56] References Cited

UNITED STATES PATENTS

| | | | |
|---|---|---|---|
| 2,101,356 | 12/1937 | Zak | 251/207 |
| 2,573,687 | 11/1951 | Brock | 239/318 X |
| 2,580,629 | 1/1952 | Wenzel | 230/318 X |
| 2,719,704 | 10/1955 | Anderson et al. | 239/318 |
| 2,724,583 | 11/1955 | Targosh et al. | 239/318 X |
| 3,042,314 | 7/1962 | Packard et al. | 239/311 X |
| 3,049,304 | 8/1962 | Sears | 239/318 |
| 3,090,564 | 5/1963 | Gilmour | 251/207 X |
| 3,191,869 | 6/1965 | Gilmour | 239/354 X |
| 3,285,521 | 11/1966 | Coakley | 239/318 |
| 3,391,868 | 7/1968 | Cooney | 239/232 |

*Primary Examiner*—Johnny D. Cherry
*Assistant Examiner*—Michael Mar
*Attorney, Agent, or Firm*—David L. Ray

[57] ABSTRACT

A lawn sprinkler adapted for spreading chemicals over a broad area. The sprinkler includes a pump for pumping fluid solutions, suspensions, or mixtures of chemicals through the nozzle of the sprinkler.

27 Claims, 8 Drawing Figures

LAWN SPRINKLER AND FERTILIZER DISPENSER

CROSS-REFERENCE TO RELATED APPLICATION

This application is related to pending application Ser. No. 439,323, filed Feb. 4, 1974 now abandoned.

BACKGROUND OF THE INVENTION

The present invention relates to a sprinkling apparatus and more particularly to an apparatus for incorporating fluid solutions, suspensions, or mixtures of chemicals such as fertilizer, insecticide or weed killer in the fluid spray of the sprinkler.

Use of fluid solutions, mixtures, or suspensions of fertilizers, weed killers, insect killers and the like, has become widespread on lawns, farms, and orchards, but the application of these materials presents certain impractical difficulties. Generally, these materials have been applied by separate pumps, or the like, such as spray guns. Many of such pumps are heavy and bulky, and make spraying a yard or orchard very difficult and unpleasant.

A sprinkler capable of spraying water-soluble materials such as fertilizers and the like through a nozzle is disclosed in U.S. Pat. No. 2,573,687. However, such sprinklers of the prior art do not have the advantages of the sprinkler of the present invention.

THE INVENTION

In accordance with the present invention there is provided a lawn sprinkler containing means for spraying fluid solutions, suspensions or mixtures of chemicals through the nozzle of the sprinkler. The sprinkler of this invention will be more fully understood by referring to the drawings in which.

Figure 1:
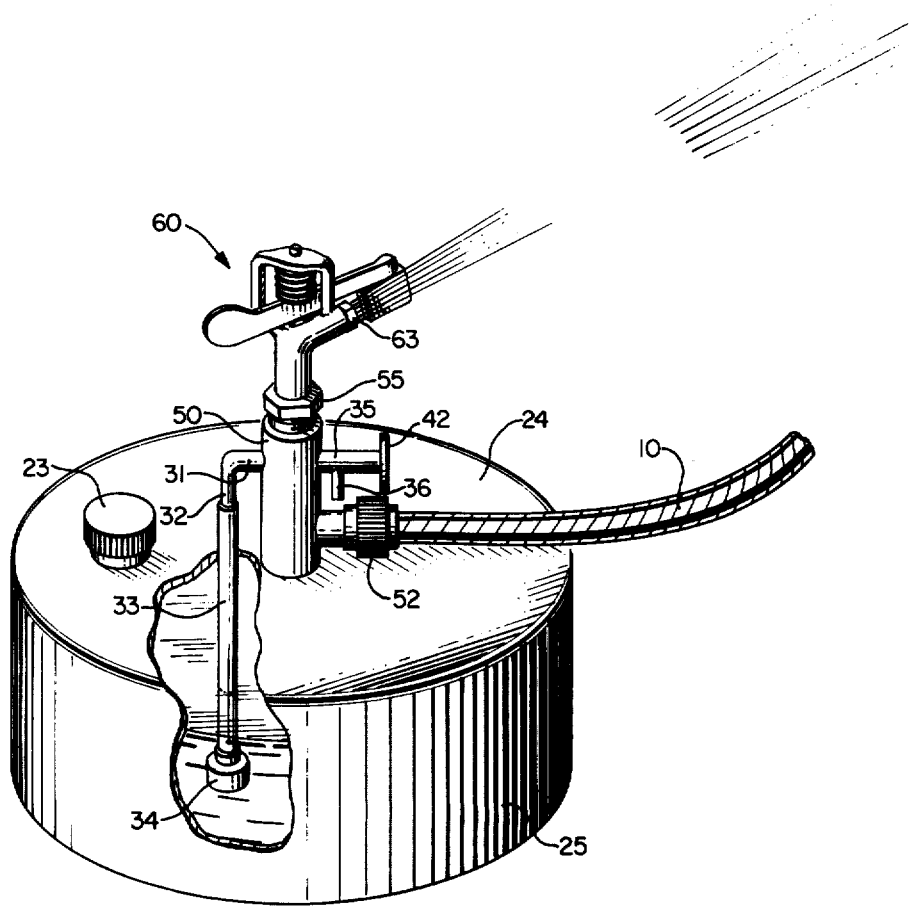
FIG. 1 is a perspective, partly cutaway view of the sprinkler of the invention.
Figure 2:
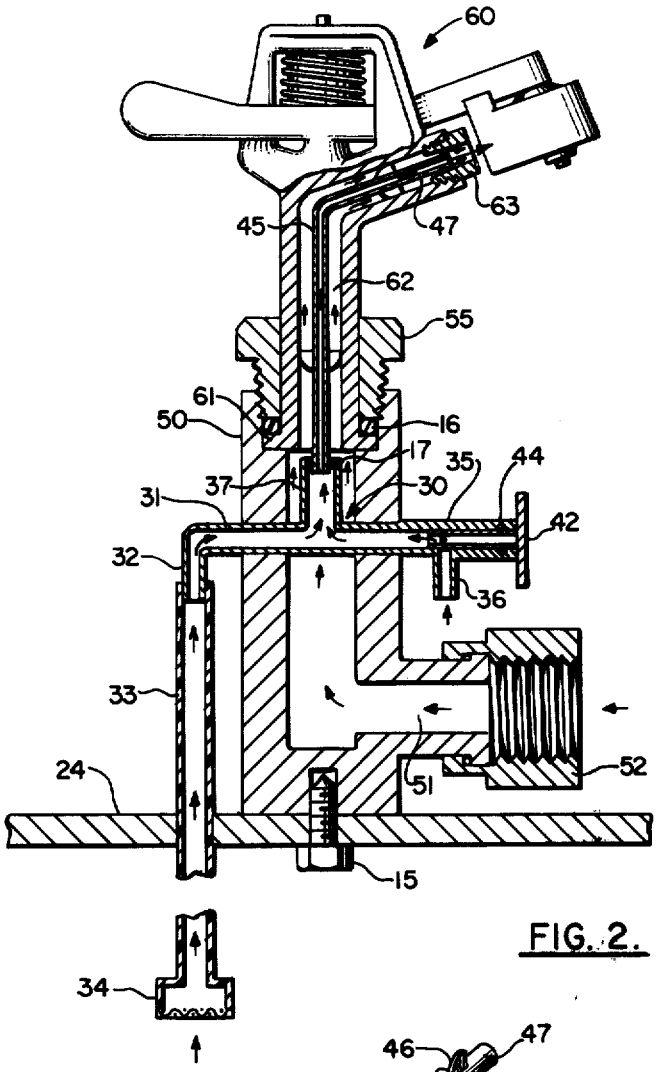
FIG. 2 is a partly sectional side view of the sprinkler of the invention.

Referring now to the drawings, and in particular to drawings 1–4, the sprinkler of the present invention can be seen to be connected to the top 24 of reservoir 25, which rests upon the ground or any other surface. Reservoir 25 contains a liquid solution, mixture, or suspension of various chemicals such as fertilizers, weed killers, insect killers, or any desired chemical. The chemicals and liquids for dissolving, suspending, or mixing the chemicals may be placed in reservoir 25 through cap 23 on top 24. As can be seen in FIGS. 1 and 2, coupling 50 is attached to the top 24 of reservoir 25 by a bolt 15. However, coupling 50 could be attached by any other means known in the art, such as welding, gluing, or the like. Coupling 50 can be seen to have a hollow chamber 51 therein through which water flows, as shown by the arrows, when a hose 10 or other water supply is connected to hose coupling 52. Hose coupling 52 is connected to coupling 50 in any conventional manner known in the art.

Coupling 50 has nut 55 threadedly connected to the top thereof which holds a rotating impact or impulse sprinkler head generally indicated by the numeral 60, which has been modified in accordance with the present invention. Impact or impulse sprinkler head 60 may be of any of the well known sprinkler heads such as those disclosed in U.S. Pat. No. 3,309,025 issued Mar. 14, 1967 to Malcomb, which is hereby incorporated by reference, and U.S. Pat. No. 3,391,868 issued July 9, 1968 to Cooney. An O-ring or washer 16 is located between nut 55 and lower lip 61 of impulse sprinkler head 60 to hold the sprinkler head 60 in place and prevent water leakage when water pressure is applied to the sprinkler and the sprinkler head begins to rotate relative to coupling 50. Located in impulse sprinkler head 60 is a channel 62 through which water from channel 51 of coupling 50 flows prior to exiting from nozzle 63.

Also located in coupling 50 is a manifold generally indicated by the numeral 30. At a first end 31 of manifold 30 is a downward turning leg, first inlet 32, to which is connected a pipe 33. The end 34 of pipe 33 terminates in reservoir 25. At a second end 35 of manifold 30 is located a second downturning leg, inlet 36, which is open to the atmosphere. In the approximate middle of manifold 30 is a third end, outlet 37, through which fluids from inlet 32 and air from inlet 36 flow.

Manifold 30 is shown in the drawings as one-piece molding. However, to facilitate assembly of the sprinkler, the manifold can be constructed so that the various components can be screwed or glued together, as is well known in the art. For example, manifold 30 could be constructed so that outlet 37 and inlet 32 screw into manifold 30.

Figure 3:
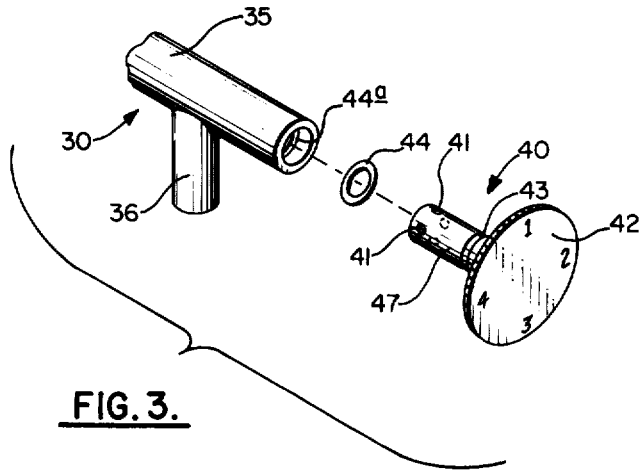
FIG. 3 is a perspective, exploded view of the flow regulator of the invention.

Also located in second end 35 is a valve or fluid flow regulator designated generally by the numeral 40, shown in detail in FIG. 3. Fluid flow regulator 40 could be eliminated by merely closing second end 35 and inlet 36 and fluids would still be pumped from reservoir 25, but the inclusion of a fluid flow regulator is preferred. Fluid flow regulator 40 includes a hollow tube 47 open at one end which fits snugly inside the second end 35 of manifold 30. Tube 47 has a series of holes 41 therein and a dial 42 connected thereto which closes one hole of tube 47. In the embodiment shown in FIG. 3, there are four holes 41 located in tube 47 which correspond to the numbers 1–4 on dial 42. Each of the holes 41 has a different diameter so that the air flowing therethrough may be increased or decreased, according to the size of the hole. The dial 42 may be turned to align one of the various holes with inlet 36 to cause air coming in through inlet 36 to flow through the aligned hole. The tube 47 has a groove 43 for receipt of O-ring 44. O-ring 44 also fits in a groove 44*a* located in the end 35 of manifold 30. Thus the flow regulator 40 is prevented from being forced outward from end 35 of manifold 30 by the vibration of impulse sprinkler head 60.

Figure 4:
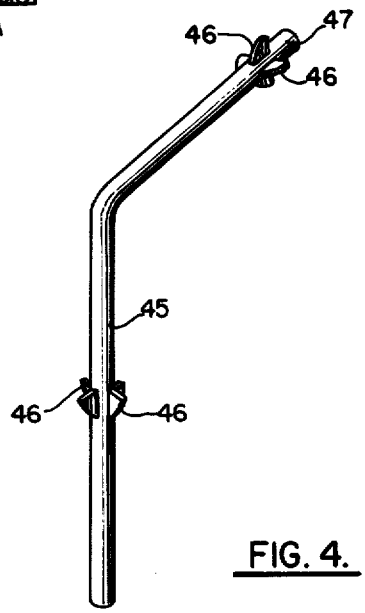
FIG. 4 is a perspective, elevational view of the aspirator of the invention.

The outlet 37 of manifold 30 points upwards from chamber 51 toward chamber 62 and has connected thereto an aspirator 45, shown in detail in FIG. 4. Aspirator 45 fits snugly into outlet 37 of manifold 30 so that no fluids can escape around the union of the aspirator 45 and manifold 30, but aspirator 45 must be free to rotate in outlet 37. Aspirator 45 may be rotatably connected to outlet 37 by any means known in the art.

Figure 8:
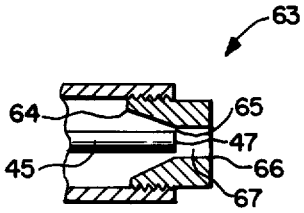
FIG. 8 is a partly sectional, elevational view of a nozzle of the invention.

Preferably, an O-ring 17 is used to provide a watertight, rotatable seal. Aspirator 45 is hollow inside and has spacers 46 located at the upper and lower ends thereof to keep aspirator 45 in the center of channel 62. As can be seen in greater detail in FIG. 8, the outlet end 47 of aspirator 45 terminates inside of nozzle 63. Nozzle 63 is a convergent nozzle, i.e., the inside diameter decreased toward the end of the nozzle from which fluids exit. Such a convergent nozzle is preferred to spray fluids long distances. The maximum inside diameter occurs at the upstream end 64 of nozzle 63 and the minimum diameter occurs at point 65 of nozzle 63.

Outlet end 47 may be located inside nozzle 63 between end 64 and point 65. To achieve maximum pumping rates through aspirator 45 outlet end 47 of aspirator 45 should be located within the channel 67, or flush with either end of channel 67. Preferably, outlet end 47 of aspirator 45 is located in channel 67 slightly downstream of point 65 or flush with point 65. The inside diameter of the channel 67 in nozzle 63 is prefe-ably constant, although the inside diameter of channel 67 could increase from point 65 to point 66. Also, if desired, channel 67 could be eliminated, although channel 67 is preferred.

The sprinkler shown in FIGS. 1–4 functions in the following manner. When hose 10 is connected by nut 52 to coupling 50 and water pressure is supplied to the hose, water flows upward through chamber 51 and through channel 62, as indicated by the arrows. As the water flows outward through nozzle 63, a low pressure area (i.e., lower than atmospheric pressure) is created at the end 47 of aspirator 45. Assuming the interior of the reservoir is at atmospheric pressure, and assuming the reservoir has fluids therein, the fluids will be forced upward through end 34 of pipe 33, upwards through pipe 33, through inlet 32 and first end 31 of manifold 30, upwards through aspirator 45 and out through the outlet end 47 of aspirator 45. If there are no liquids in reservoir 25, air alone will be pumped from reservoir 25, and only air will exit through outlet end 47 of aspirator 45. If the dial 42 is turned to a position so that no hole 41 is aligned with inlet 36, no air will be drawn through inlet 36 and maximum pumping rates will be achieved from the reservoir. However, if one of the holes 41 is aligned with inlet 36, air will flow from the atmosphere through inlet 36, through hole 41, second end 35, and upward through outlet 37 of manifold 30, as indicated by the arrows, thereby reducing the rate at which fluids are pumped out of reservoir 25. Inlet 36 could be eliminated and replaced with a hole in end 35 positioned so one of the holes 41 would align therewith and allow air to enter manifold 30. Since each of the holes opposite the numbers on dial 42 has a diameter different from that of the other holes, the rate at which fluids are pumped from reservoir 25 can be varied by turning dial 42 to admit varying amounts of air.

Figure 5:
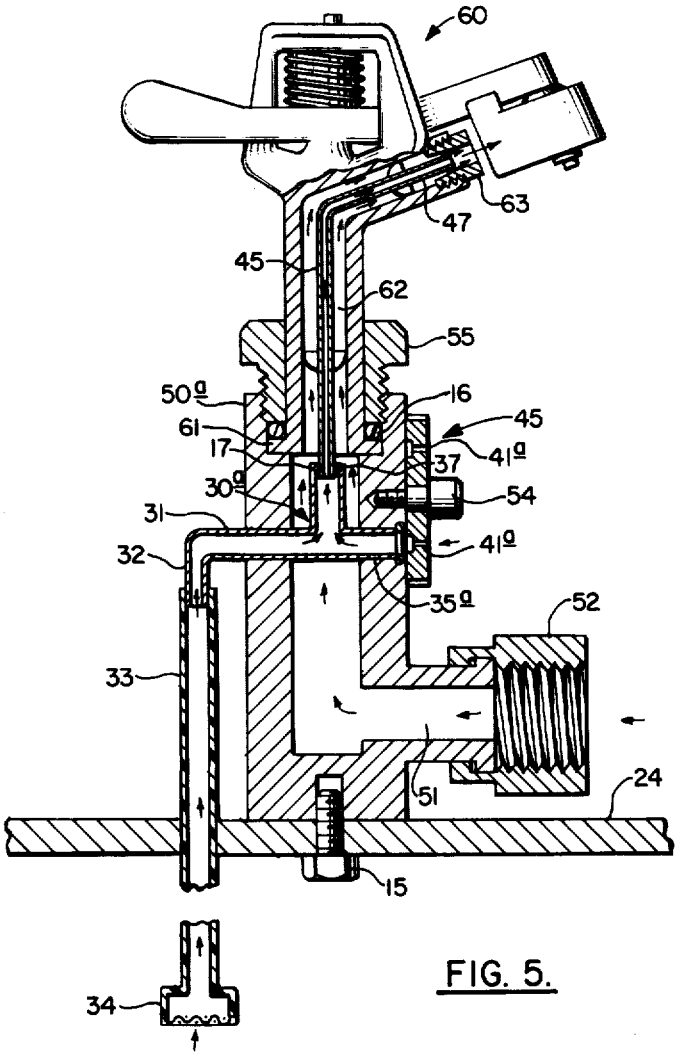
FIG. 5 is a partly sectional, elevational view of another embodiment of the sprinkler of the invention.
Figure 6:
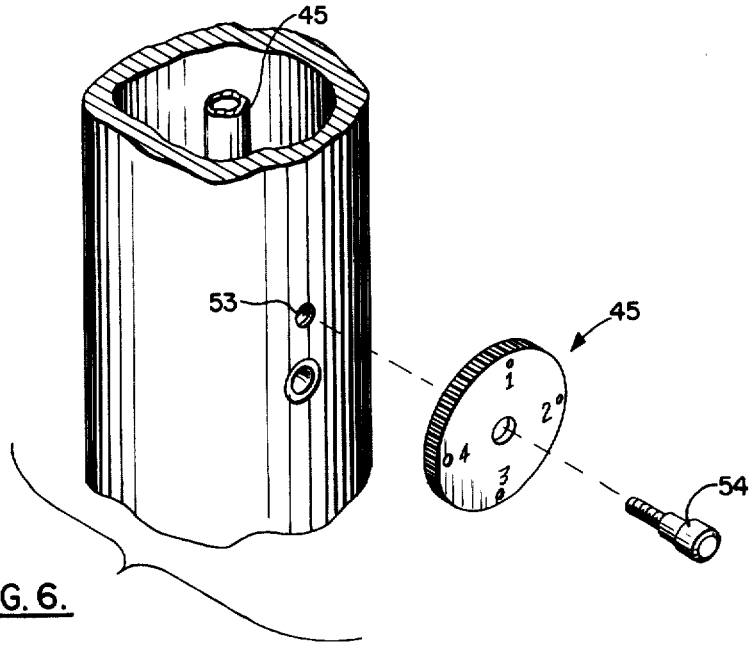
FIG. 6 is a partly sectional, exploded view of another flow regulator of the invention.

In FIGS. 5 and 6 are shown another embodiment of the present invention where all parts having numbers previously mentioned correspond in construction and function to the identically numbered parts previously described. The embodiment shown in FIGS. 5 and 6 is similar to the embodiment described in FIGS. 1–4, except that the flow regulator of the embodiment shown in FIGS. 5 and 6 differs from that shown in FIGS. 1–3. Referring now to FIGS. 5 and 6, the valve or flow regulator designated generally by the numeral 45 is a dial having a series of numbers 1–4 thereon and holes 41*a* therein. Holes 41*a* vary in diameter as did holes 41 previously described. The coupling indicated by the number 50*a* is the same as coupling 50 with the exception that there is a threaded hole 53 therein into which a screw 54 is inserted to hold dial 45 in place. Manifold 30*a* is the same as manifold 30 previously described, except that second end 35*a* fits flush with the edge of coupling 50*a* and inlet 36 has been eliminated. The operation of the embodiment shown in FIGS. 5 and 6 is the same as that previously described, except that varying pumping rates are achieved by turning dial 45 so that the holes 41*a* of various diameter are aligned with second end 35*a* of manifold 30*a*. If the dial is placed in a position such that no hole is aligned with end 34*a*, the maximum pumping rate will be achieved from the reservoir.

Figure 7:
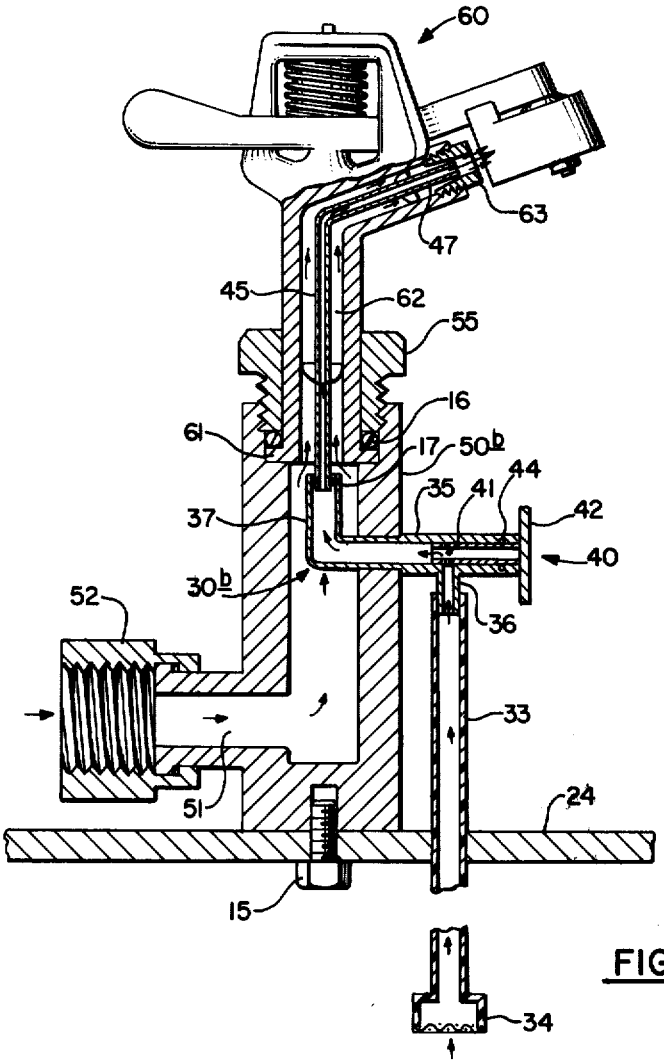
FIG. 7 is a partly sectional, elevational view of another embodiment of the invention.

An additionally preferred embodiment is shown in FIG. 7. In this embodiment all parts having numbers previously mentioned correspond in construction and function the identically numbered part previously described. In the embodiment shown in FIG. 7, manifold 30*b* is similar to the right half of manifold 30 shown in FIG. 2 since it has an outlet 37 which is connected to aspirator 45 and which has an end 35 with an inlet 36 connected thereto. However, manifold 30*b* has no inlet 32 nor end 31. Located in manifold 30*b* is flow regulator 40 previously described and shown in detail in FIG. 3. Connected to inlet 36 is conduit 33 having connected thereto end 34. The sprinkler of the embodiment of FIG. 7 operates in the same manner as previously described, except that instead of air flowing through inlet 36 and holes 41, the fluids from the reservoir flow therethrough. Thus there is a direct control of the flow rate of the solution flowing through aspirator 45 and out of aspirator end 47 without the necessity of mixing air or other gases therewith.

It can be seen that in all embodiments, aspirator 45, conduit 33, and manifold 30, 30*a* or manifold 30*b* form a conduit for conveying fluids from reservoir 25 to nozzle 63. The rate of flow of fluids from the reservoir may be varied by valves which mix air with the fluids or vary the size of the passageways in the conduit.

If desired, a rotary sprinkler head may be used which is not of the impulse type. For example, see my U.S. Pat. No. 3,709,435, which is hereby incorporated by reference.

Also if desired, a stationary, non-rotating sprinkler could be used. For example, sprinkler head 60 could be rigidly connected to nut 55 to prevent rotation.

Having fully described the present invention, it is desired it be limited only within the spirit and scope of the following claims.

What is claimed is:

1. A lawn, farm and orchard sprinkler comprising:
   a. reservoir means for containing fluid solutions, suspensions, or mixtures of chemicals,
   b. coupling means connected to said reservoir means, said coupling means having chamber means for conveying liquids under pressure, said coupling means including liquid inlet means for introducing liquids under pressure to said chamber means,
   c. sprinkler head means rotatably connected to said coupling means, said sprinkler head means including:
      i. nozzle means for spraying fluids,
      ii. channel means connected to said nozzle means and to said chamber means for conveying liquids under pressure from said chamber means to said nozzle means;

d. manifold means connected to said coupling means for conveying fluids from said reservoir means to said nozzle means, said manifold means having a first inlet for admitting said fluids from said reservoir means, a second inlet for admitting air, and an outlet inside said chamber means for said air and said fluids;

e. flow regulating means connected to said manifold means for regulating the rate of flow of fluids from said reservoir means to said nozzle means, said flow regulating means comprising valve means for admitting air to said manifold means to mix with fluids conveyed from said reservoir means prior to the exit of said fluids from said outlet of said manifold means, said valve means comprising hollow tube means contained within said manifold means and rotatably connected to said manifold means, said tube means having one open end and one closed end, said tube means having at least one hole in the side thereof positioned for alignment with said second inlet for admitting air upon rotation of said tube to an aligning position to permit air to enter said manifold means through said hole;

f. aspirator means located in said channel means and rotatably connected to said outlet for said air and said fluids for conveying said air and said fluids from said manifold means to said nozzle means, the outlet end of said aspirator means being located in said channel means upstream from said nozzle means; and, g. pipe means connected to said first inlet means for conveying fluids from said reservoir to said manifold means.

2. The sprinkler of claim 1 wherein the outlet end of said conduit means is located within said nozzle means.

3. The sprinkler of claim 2 wherein said nozzle means is a convergent nozzle.

4. The sprinkler of claim 3 wherein the outlet end of said conduit means is located substantially adjacent to the point of minimum inside diameter of said nozzle means.

5. The sprinkler of claim 1 wherein said tube means has a plurality of said holes in the side thereof.

6. The sprinkler of claim 1 wherein said sprinkler head means is an impulse sprinkler head.

7. The sprinkler of claim 1 wherein said nozzle means is a convergent nozzle.

8. A lawn, farm and orchard sprinkler comprising:

a. reservoir means for containing fluid solutions, suspensions, or mixtures of chemicals;

b. coupling means connected to said reservoir means, said coupling means having chamber means for conveying liquids under pressure, said coupling means including liquid inlet means for supplying liquids under pressure to said chamber means;

c. sprinkler head means rotatably connected to said coupling means, said sprinkler head means including:

i. nozzle means for spraying fluids, ii. channel means connected to said nozzle means and to said chamber means for conveying liquids under pressure from said chamber means to said nozzle means;

d. manifold means connected to said coupling means for conveying fluids from said reservoir to said nozzle means, said manifold means having at least one inlet means inside said chamber means and at least one outlet means;

e. flow regulating means connected to said manifold means for regulating the rate of flow of fluids from said reservoir means, said flow regulating means comprising valve means for selectively reducing the size of the passageway for fluids flowing through said inlet means;

f. aspirator means located in said chamber means and rotatably connected to said outlet means for conveying fluids from said manifold means to said nozzle means, the outlet end of said aspirator means being located in said channel means upstream from said nozzle means; and, g. pipe means connected to said inlet means for conveying fluids from said reservoir to said manifold means.

9. The sprinkler of claim 8 wherein said valve means comprises hollow tube means rotatably contained within said manifold means, said hollow tube means having one open end and one closed end, said hollow tube means having at least one hole in the side thereof positioned for alignment with said manifold inlet means to permit fluids from said reservoir to flow through said hole into said manifold.

10. The sprinkler of claim 9 wherein said tube means has a plurality of said holes in the side thereof.

11. The sprinkler of claim 8 wherein the outlet end of said aspirator means is located within said nozzle means.

12. The sprinkler of claim 11 wherein said nozzle means is a convergent nozzle.

13. The sprinkler of claim 12 wherein the outlet end of said conduit means is located substantially adjacent to the point of minimum inside diameter of said nozzle means.

14. The sprinkler of claim 13 wherein said sprinkler head means is an impulse sprinkler head.

15. The sprinkler of claim 14 wherein said nozzle means is a convergent nozzle.

16. The sprinkler of claim 8 wherein said valve means comprises hollow tube means rotatably contained within said manifold means, said hollow tube means having one open end and one closed end, said hollow tube means having at least one hole in the side thereof positioned for alignment with said inlet means to permit fluids from said reservoir to flow through said hole into said manifold.

17. The sprinkler of claim 8 wherein the outlet end of said aspirator means is located within said nozzle means.

18. The sprinkler of claim 17 wherein said nozzle means is a convergent nozzle.

19. The sprinkler of claim 18 wherein the outlet end of said conduit means is located substantially adjacent to the point of minimum inside diameter of said nozzle means.

20. A lawn, farm and orchard sprinkler comprising:

a reservoir means for containing fluid solutions, suspensions, or mixtures of chemicals;

b. coupling means connected to said reservoir means, said coupling means having chamber means for conveying liquids under pressure, said coupling including liquid inlet means for introducing liquids under pressure to said chamber means;

c. sprinkler head means rotatably connected to said coupling means, said sprinkler head means including:

i. nozzle means for spraying fluids, ii. channel means connected to said nozzle means and to said chamber means for conveying liquids under pressure from said chamber means to said nozzle means;

d. manifold means connected to said coupling means for conveying fluids from said reservoir to said nozzle means, said manifold means having a first inlet for admitting said fluids from said reservoir, a second inlet for admitting air, and an outlet inside said chamber means for said air and said fluids;

e. flow regulating means connected to said manifold means for regulating the rate of flow of fluids from said reservoir means to said nozzle means, said flow regulating means comprising valve means for regulating the amount of air entering said second inlet for air;

f. aspirator means located in said channel means and rotatably connected to said outlet for said air and said fluids for conveying fluids from said manifold means to said nozzle means, the outlet end of said aspirator means being located in said channel means upstream from said nozzle means; and g. pipe means connected to said first inlet means for conveying fluids from said reservoir to said manifold means.

21. The sprinkler of claim 20 wherein said valve means comprises rotatable dial means connected to said sprinkler and slidingly contacting and sealing the end of said second inlet for admitting air, said dial means having at least one hole therein positioned for alignment with said second inlet for admitting air upon rotation of said tube to an aligning position to allow air to enter said manifold means through said hole.

22. The sprinkler of claim 57 wherein said dial means has a plurality of said holes therein.

23. The sprinkler of claim 22 wherein said sprinkler head means is an impulse sprinkler head.

24. The sprinkler of claim 20 wherein said nozzle means is a convergent nozzle.

25. The sprinkler of claim 20 wherein the outlet end of said aspirator means is located within said nozzle means.

26. The sprinkler of claim 25 wherein said nozzle means is a a convergent nozzle.

27. The sprinkler of claim 26 wherein the outlet end of said conduit means is located substantially adjacent to the point of minimum inside diameter of said nozzle means.

* * * * *